US005445194A

United States Patent [19]

Clüsserath

[11] Patent Number: 5,445,194

[45] Date of Patent: Aug. 29, 1995

[54] FILLING ELEMENT FOR FILLING MACHINES FOR DISPENSING A LIQUID FILLING MATERIAL INTO CONTAINERS

[75] Inventor: Ludwig Clüsserath, Bad Kreuznach, Germany

[73] Assignee: KHS Maschinen- und Anlagenbau Aktiengesellschaft, Bad Kreuznach, Germany

[21] Appl. No.: 209,161

[22] Filed: Mar. 10, 1994

[30] Foreign Application Priority Data

Mar. 10, 1993 [DE] Germany ..... 43 07 521.5
Nov. 12, 1993 [DE] Germany ..... 43 38 669.5

[51] Int. Cl.[6] ..... B65B 31/00

[52] U.S. Cl. ..... 141/39; 141/48; 141/92; 141/146

[58] Field of Search ..... 141/39, 40, 6, 48, 51, 141/95, 263, 146, 147, 90–92, 63, 144, 374

[56] References Cited

U.S. PATENT DOCUMENTS

| | | | |
|---|---|---|---|
| 2,605,949 | 8/1952 | Stern | 141/39 |
| 2,896,674 | 7/1959 | Day et al. | 141/39 |
| 3,799,219 | 3/1974 | Uth et al. | 141/39 |
| 4,086,943 | 5/1978 | Fernandez | 141/39 |
| 4,386,635 | 6/1983 | Ahlers | 141/6 |
| 4,982,768 | 1/1991 | Ahlers | 141/6 |
| 5,000,234 | 3/1991 | Weiss | 141/6 |
| 5,031,673 | 7/1991 | Clüsserath | 141/6 |
| 5,163,487 | 11/1992 | Clüsserath | 141/92 |
| 5,329,963 | 7/1994 | Jones et al. | 141/6 |

FOREIGN PATENT DOCUMENTS

| | | | |
|---|---|---|---|
| 700191 | 12/1940 | Germany | 141/39 |

*Primary Examiner*—J. Casimer Jacyna
*Assistant Examiner*—Steven O. Douglas
*Attorney, Agent, or Firm*—Robert W. Becker & Associates

[57] ABSTRACT

A filling element, preferably a filling element that has no filling tube or only a short filling tube, for filling machines for dispensing a liquid filling material into bottles or similar containers. The filling element has an operational element that can be moved between an upper and a lower lifting or stroke position. The movement is effected by the pressure of at least one operating medium that is also supplied to the container during the filling phase and/or at least one treatment phase that precedes or follows this filling phase.

23 Claims, 7 Drawing Sheets

FILLING ELEMENT FOR FILLING MACHINES FOR DISPENSING A LIQUID FILLING MATERIAL INTO CONTAINERS

BACKGROUND OF THE INVENTION

The present invention relates to a filling element for filling machines for dispensing a liquid filling material into bottles or similar containers. The filling element has a liquid channel that is provided with a liquid flow valve and that forms a discharge opening via which, during a filling phase with the liquid flow valve open, the liquid filling material flows into a container that has been placed against the filling element.

Numerous types of filling elements are known, including a filling element wherein an operational element in the form of a suction tube that determines the filling height is movable by means of a control means in a vertical filling element axis between an upper stroke position and a lower stroke position, whereby this movement is controlled as a function of the respective operating state in which the filling element is at any given time.

With this known embodiment, for each filling element, i.e. for the operational element thereof, there is used as a control means a lifting system that is provided with a guide or cam roller and that cooperates with a lifting cam.

Another filling element is known from U.S. Pat. No. 5,163,487, Clusserath. This filling element is suitable, for example, with a method or a filling machine for the aseptic or sterile dispensing of a liquid material into containers, especially bottles. This known filling element is provided with a filling tube that projects beyond the underside of the filling element. The actual filling phase, which is initiated with the opening of the liquid flow valve, is preceded by, among other things, the treatment or sterilization of the respective container with a hot sterilization medium, preferably steam. For this purpose, the filling tube, via a controllable sterilization medium connection that is formed in the filling element, is connected to a source for the hot sterilization medium, so that this medium discharges at the bottom end of the filling tube that projects into the container. It is critical for the quality of the sterilization that the end of the filling tube, i.e. the discharge location for the sterilization medium, which discharge location is determined by the end of the filling tube during the sterilization process, be disposed deep enough in the container, at a slight distance from the base of the container, that the base of the container is adequately subjected to the sterilization medium and an intensive flow of the sterilization medium results, for example in an outward direction along the base of the container radially relative to the container axis or to the axis of the filling element or of the filling tube, and then axially upwardly from the base of the container, especially along the inner surface of the periphery of the container, as a result of which an optimum sterilization of the interior of the container, even in the lower region, i.e. especially along the inner surface of the base, and also of the periphery of the container and in the angular portion formed between these two regions.

One of the drawbacks of this known filling element is that for the introduction of the filling tube into the container, which filling tube is as long as possible for an optimum sterilization, a relatively great lift or stroke is necessary for the container that is disposed on a container carrier until the container rests against the filling element in a sealing manner (the sealing position). Thus, a relative long cycle time is necessary until the container has achieved the sealing position and it is possible to subject the interior of the container with the pressure of the hot sterilization medium, as is necessary in many cases in order to achieve an optimum sterilization result.

It is an object of the present invention to provide a filling element where the operational element is movable in a controlled and particularly straightforward manner between an upper and a lower lifting or stroke position as a function of the respective operating state of the filling element.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
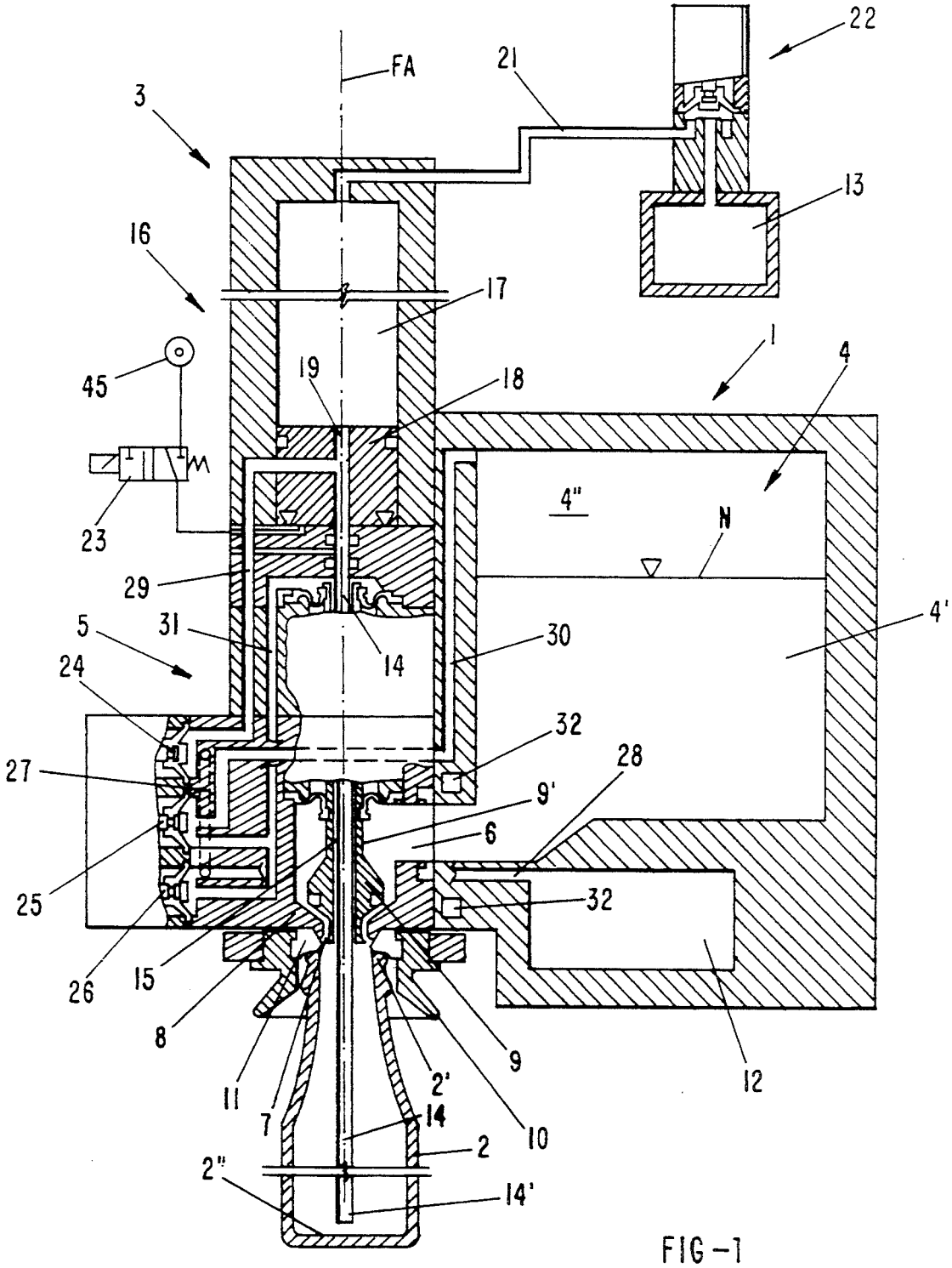
FIG. 1 is a simplified cross-sectional view of one exemplary embodiment of the inventive filling element, which has no filling tube and is intended for a rotating-type counter pressure bottle filling machine, with FIG. 1 also showing the annular tank of the filling machine and a bottle that has been placed against the filling element.

The filling element of the present invention comprises an operational element that is adapted to be introduced into the container, and a control means for moving the operational element, in the direction of the axis of the filling element, between a lower stroke position, in which at least in the filling phase a given length of the operational element extends beyond an underside of the filling element and into the container that has been placed thereagainst, and an upper stroke position in which at least a portion of the given length of the operational element is retracted into the filling element, with the filling element having no filling tube or at most a short filling tube, and wherein the control means is a piston/cylinder arrangement with at least one cylinder and one piston that is displaceable therein, with the piston defining within the cylinder at least one cylinder chamber to which, for a stroke movement of the operational element, can be supplied the pressure of at least one operating medium that is also supplied to the container during at least one of the filling phase and treatment phases that precede and follow the filling phase.

Pursuant to the present invention, the upward and downward movement of the operational element, which is, for example, a sterilization tube or an element, such as a probe, that determines the filling height, is effected by at least one gaseous operating medium that is also supplied to the container during the filling process. This operating medium is, for example, an inert compressed gas and/or a sterilization medium and/or a vacuum or underpressure.

By using the operating medium for the movement of the operational element, it is possible in a particularly advantageous manner to simultaneously use for the control of this stroke movement the same control agent that is also provided for the controlled supply to the container of the respective operating medium. This results, among other things, in a very straightforward construction and a simplified control for the control medium.

A further advantage of the present invention is that in addition to the operating medium that is used and required during the filling process, no further control and operating medium is necessary for the lifting or stroke movement of the operational element.

The inventive filling element preferably has no filling tube or at most a short filling tube, so that to place the respective container against or withdraw it from the filling element, a short stroke and hence also a short cycle time are adequate.

If the operational element is a sterilization tube, when a treatment of the respective container with the sterilization medium is provided, during or after placement of the container against the filling element the sterilization tube is then moved out of its upper stroke position into its lower stroke position in which the lower end of this tube, which is provided with at least one discharge opening, extends deeply into the container, and in particular with the least possible spacing relative to the base of the container, so that an optimum sterilization of the entire interior of the container is possible with a minimum quantity of sterilization medium and in a short treatment cycle. The sterilization tube, and the parts connected therewith, especially the control means provided for the movement of the tube, can have a small mass. Therefore, no great mass accelerations are necessary, which is of great significance especially with filling machines that operate at a high efficiency.

By means of the control elements that control the respective filling element, in particular also the sterilization tube and the pertaining control means are controlled in such a way that at least during the filling phase, and preferably also during a pressurizing phase that might precede this filling phase and in which the interior of the container, which is in a sealing position relative to the filling element, is pressurized to a prescribed pressure, the sterilization tube is disposed in the upper stroke position such that if a possibly defective container bursts or breaks, this tube will not be damaged, and in particular is also protected from having liquid filling material deposit on the tube; this also contributes to an increase in the quality of the sterilization.

Pursuant to one preferred specific embodiment of the present invention, the control means is embodied in such a way that the sterilization tube is moved and held in the lower stroke position by the pressure of the sterilization medium. In this way not only is a simplification of the control means and the pertaining control achieved, but in addition there is also ensured that the sterilization tube will be in the lower stroke position when hot sterilization medium is discharged therefrom.

During the sterilization, the sterilization medium discharges from the lower end of the sterilization tube. However, embodiments are also conceivable where the sterilization medium that is supplied to the container, for example via a gas channel, is withdrawn from the container via the lower end of the sterilization tube, whereby in this case it is then, for example, also possible to withdraw condensate or residual condensate that might form with the sterilization medium via the sterilization tube.

Furthermore, with the present invention it is also possible to connect the sterilization tube to a source for a partial vacuum in order in this manner to evacuate the container via the sterilization tube, and preferably also to remove liquid or condensate. Finally, with the present invention it is also possible to provide such a control that already in the upper stroke position hot sterilization medium discharges from the sterilization tube, whereby especially prior to the placement of a container against a filling element it is possible to treat with the sterilization medium those parts that come into contact with the container in the region of the mouth thereof. With the present invention the sterilization tube is also introduced into the respective container to such an extent that the base of the container is adequately subjected to the sterilization medium.

Further specific features of the present invention will be described in detail subsequently.

DESCRIPTION OF PREFERRED EMBODIMENTS

Referring now to the drawings in detail, an annular tank 1 is shown that is provided on an otherwise not illustrated filling machine rotor that rotates about a vertical machine axis. The annular tank 1 serves for filling the bottles 2 with a carbonated beverage, such as beer.

Formed at the periphery of the rotor, i.e. of the annular tank 1, are a number of filling stations, each of which has a filling element 3 and therebelow a bottle carrier that can be moved up and down in a vertical direction. The filling elements 3 are secured to the periphery of the annular tank 1. The annular tank forms an inner chamber 4 that surrounds the vertical machine axis in a ring-like manner and that is filled to a prescribed level N with the beverage or liquid filling material, so that below the level N a liquid chamber 4' that is occupied by the liquid filling material is formed, while above the level N a gas chamber 4'' is formed for a pressurized gas, for example an inert gas (e.g. $CO_2$ gas).

Each filling element has a housing 5, in the lower portion of which is formed a liquid channel 6, one end of which communicates with the filling material chamber 4', while at the underside of the filling element 3, i.e., of the housing 5, the liquid channel 6 forms an annular discharge opening 7 that concentrically surrounds the vertical filling element axis FA. The liquid flow valve 8 is provided in the liquid channel 6; in FIG. 1, the liquid flow valve 8 is shown in its open position. The liquid flow valve comprises a valve body 9 that, by actuating means that are not illustrated in detail, can be moved in the direction of the axis FA by a prescribed movement stroke for opening and closing. In the closed state of the liquid flow valve 8, a surface of the valve body 9 rests against a valve seat formed in the liquid channel 6. Also shown are a centering tulip 10 and an annular sealing means 11 that surrounds the discharge opening 7 and against which the mouth 2' of the bottle 2 is pressed when the bottle is in a sealing position relative to the filling element 3.

Provided in the annular tank 1 below the inner chamber 4 is an annular residual gas channel 12 that is common to all of the filling elements 3. Also provided on the annular tank 1, or on the rotor that is provided with this annular tank, is a supply channel 13 for the sterilization medium, namely steam; this supply channel 13 is again common to all of the filling elements 3.

Each filling element 3 has a sterilization tube 14 that is coaxial with the axis FA. The bottom end 14' of the tube is open, and the tube extends through a bore of the valve body 9 that extends coaxial to the axis FA. The outer diameter of the sterilization tube 14 and the inner diameter of the bore of the valve body 9 are coordinated with one another in such a way that a gas or annular channel 15 results within the valve body 9, i.e. within a stem or plunger-like extension 9' that is integrally formed with the valve body and extends upwardly. The annular channel 15 is open at the underside of the filling element 3 and is concentrically surrounded by the annular discharge opening 7. By means of an actuating or control means 16 provided on the upper side of the filling element 3, the sterilization tube 14 can be displaced in the direction of the axis FA by a prescribed stroke in such a way that in the upper stroke position the end 14' of the tube is disposed at the same level or nearly the same level as the lower end of the valve body 9, in other words, is retracted into the filling element 3, i.e., into the valve body 9; in the lower stroke position illustrated in FIG. 1, the end 14' of the tube is introduced into the bottle 2 that rests against the filling element 3 to such an extent that the end 14' of the tube is disposed in the immediate vicinity of the inner surface of the base 2'' of the bottle 2, or at least is spaced from the base only to such an extent that the base is also adequately supplied with steam.

The control means 16 is formed by a cylinder 17 in which is provided a piston 18 that can be displaced in the direction of the axis FA. The upper, open end of the sterilization tube 14 is secured to the piston 18. A channel 19 that extends coaxially with the axis FA is provided in the piston 18. By means of this channel 19, the upper, open end of the sterilization tube 14 communicates with that side of the piston 18 that is remote from this tube.

A channel 21 opens above the piston 18 into that chamber of the cylinder 17 that is remote from the sterilization tube 14. Each filling element 3 has a separate electrical control valve 22 that is individually controllable and via which the channel 21 is connected to the supply channel 13.

By means of an electrically actuatable control valve 23 that is a gain separately provided for each filling element 3, that portion or chamber of the cylinder 17 that is provided below the piston 18 can, in a controlled manner, be supplied with a pneumatic pressure from a control pressure line 45 or can be vented to the atmosphere.

Each filling element 3 is furthermore provided with three individually controllable control valves 24–26 that form a control unit and control various channels that are formed partially in the housing 5 of the filling element and partially in the annular tank 1. The control valves 24–26 are connected to various channels in the following manner:

Control valve 24:

The inlet side is connected to a connecting channel 27 that opens into a channel 28 that leads to the residual gas channel 12, and the outlet side is connected to a channel 29 that opens out on the inner surface of the cylinder 17 and, when the piston 18 or the sterilization tube 14 are disposed in the lower stroke position, communicates with the channel 19.

Control valve 25:

The inlet side is connected to a channel 30 that leads to the gas chamber 4'', and the outlet side is connected to the gas channel 15.

Control valve 26:

The inlet side is connected to the channel 31, and the outlet side is connected to the channel 28.

The special feature of the filling element 3 is that when the sterilization tube 14 is in its upper stroke position, where control pressure is supplied to the underside of the piston 18 via the control valve 23, then by opening the control valve 22 steam can discharge at the end 14' of the tube and hence at the underside of the filling element 3 in order to sterilize parts and surfaces that are located there as well as the bottle 2 when the region of the mouth 2' thereof is placed against the filling element.

After the bottle 2 has been placed against the filling element 3, the sterilization tube 14 is completely introduced into the bottle, so that the end 14' of the tube is disposed in the immediate vicinity of the inner surface of the base 2''. The pressure of the sterilization medium or steam is utilized for introducing the sterilization tube 14 into the bottle 2, with this pressure acting upon the upper surface of the piston 18 when the control valve 22 is opened; an appropriate or controlled venting of the chamber of the cylinder 17 that is formed below the piston 18 is effected via the control valve 23. The cross-sectional area of the piston 18 relative to the cross-sectional area of the sterilization tube 14 ensures that the sterilization medium exerts a great enough pressure upon the upper side of the piston 18 although this sterilization medium continuously discharges at the lower end 14' of the tube.

Since the end 14' of the tube is disposed immediately above the inner surface of the base 2'', a stream of steam results in the bottle 2 that passes from the end 14' of the tube radially outwardly along the base 2'' and then axially upwardly, so that all of the regions of the inner surface of the bottle are intensively treated with the sterilization medium or steam, which at least during a portion of a sterilization phase is withdrawn via the annular channel 15 into the residual gas channel and to the atmosphere.

A further fundamental advantage is that by means of the retractable sterilization tube 14, despite an optimum sterilization only a small stroke is needed for the bottle carrier, and furthermore the sterilization tube 14 is protected in the retracted state especially when the bottle is entering or leaving the filling machine, but also during the critical phases of the filling process, for example during pressurization of the bottle 2 to the filling pressure. As will now be explained in detail, the filling element 3 enables the following operations:

1. Loading of the valve outer parts

As the filling element 3 passes through the phase angle formed between the bottle outlet and the bottle inlet of the filling machine, by opening the respective control valve 22 with the sterilization tube 14 in the upper stroke position steam is discharged at the lower end 14' of the tube. In so doing, the lower cylinder chamber of the cylinder 17 is supplied with the control pressure.

2. Displacement of the air out of the bottle via steam

Immediately after the bottle 2 is pressed against the filling element 3, by again opening the control valve 22 a full stream of steam is introduced into the upper part of the cylinder 17. At the same time, the lower partial chamber of the cylinder 17 is vented via the control valve 23, so that the sterilization tube 14 is moved downwardly out of the upper stroke position and is introduced increasingly deeper into the bottle 2. By means of the steam that exits the end 14' of the tube, the air in the bottle 2, which is disposed in a sealing position against the filling element 3, is increasingly displaced out of the bottle and is withdrawn via the annular channel 15 and opened control valve 26 to the residual gas channel 12, which is, for example, at atmospheric pressure. An optimum sterilization of the inner surfaces of the bottle 2 is effected by the stream of steam. The sterilization tube 14 is also included in this sterilization, with both the inside and the outside of the tube being sterilized by the steam.

3. Sterilization of the bottle 2 and the filling element 3 under overpressure After the air has been completely displaced out of the bottle 2, the control valve 26 is closed so that with the control valve 22 still open and via the sterilization tube 14, steam is introduced into the bottle 2 until a pressure equalization with the pressure in the supply channel 13 is achieved.

4. Displacing steam with inert gas or $CO_2$

After the conclusion of a prescribed sterilization time, the control valve 22 is closed. At the same time, with the control valve 26 again opened, the steam overpressure is withdrawn into the residual gas channel 12. Immediately thereafter, the control valves 24 and 25 are opened so that via the channels 30 and 31 as well as via the annular channel 15, inert gas passes out of the gas chamber 4'' into the bottle 2, thereby displacing the residual steam to the residual gas channel 12 via the sterilization tube 14, the channel 29, the connecting channel 27, and the channel 28. Since the end 14' of the tube is provided in the immediate vicinity of the inner surface of the base 2'', the aforementioned displacement can also remove condensate residue from the bottle 2.

5. Pressurization of the bottle 2

For this pressurization, the valve 24 is closed so that the pressurization can be effected via the opened valve 25 and the channels 30 and 31. For the pressurization of the bottle 2, the sterilization tube 14 is moved into its upper stroke position by appropriate operation of the control valve 23, so that the tube 14 is retracted completely into the filling element 3 and hence is also protected from fragments of glass bottles that might burst.

Subsequent to the aforementioned steps, there is then effected, for example in the conventional process steps, the filling of the bottle 2 (by opening the liquid flow valve 8 and also venting and withdrawing the filled bottle). In this connection, the filling preferably includes a number of phases, and in particular a slow filling phase, a rapid filling phase, and a subsequent slow filling phase.

During the filling, the sterilization tube 14 is again disposed in the upper stroke position. Since the filling element 3 thus has no elements that during the filling extend into the interior of the bottle 2 and could be used as the member or probe that determines the filling height, there is provided for each filling element 3 a magnetic inductive flowmeter 32 (MIF) that delivers to a control means a signal that corresponds to the flow volume, i.e. to the volume that flows to the respective bottle 2 when the liquid flow valve 8 is opened; when the measured quantity or volume corresponds to a prescribed value, the control means delivers a signal that effects closing of the liquid flow valve 8.

In the described embodiment of the control means 16, it is possible to embody the sterilization tube 14 in such a way that in its lower stroke position, the lower end 14' of the tube rests upon the bottle base 2'', and in particular in such a way that at the same time steam can discharge. For this purpose, the end 14' of the sterilization tube 14, or the rim thereof, is provided, for example, with indentations or recesses in such a way that as a result thereof projections are formed at the lower end of the tube with recesses being formed between these projections that are open toward the inside of the tube, the outside of the tube, and the underside of the tube. Thus, if when in the lower stroke position the end 14' of the sterilization tube 14 rests upon the base 2'' of the bottle 2, independent of tolerances of the bottles 2 essentially the same conditions can always be achieved when treating these bottles.

Changes and modifications of the aforementioned method of operation are possible. For example, it is possible via the steam that is introduced via the sterilization tube 14 to displace out of the respective bottle 2 merely the air without subsequently also supplying to the bottle 2 the steam pressure of the supply channel 13.

The cleaning in place (CIP) cleaning of the filling elements 3 is preferably carried out such that the upper partial chamber of the cylinder 17 above the piston 18 is supplied with pressurized CIP media, and in particular with the lower cylinder chamber being vented via the control valve 23. In this way, the sterilization tube 14 is moved into the lower stroke position, with its entire length extending into the rinsing sleeve that is placed upon the filling element during the CIP cleaning, so that the inside and outside of the entire length of the sterilization tube 14 can be included in the CIP cleaning.

Figure 2:
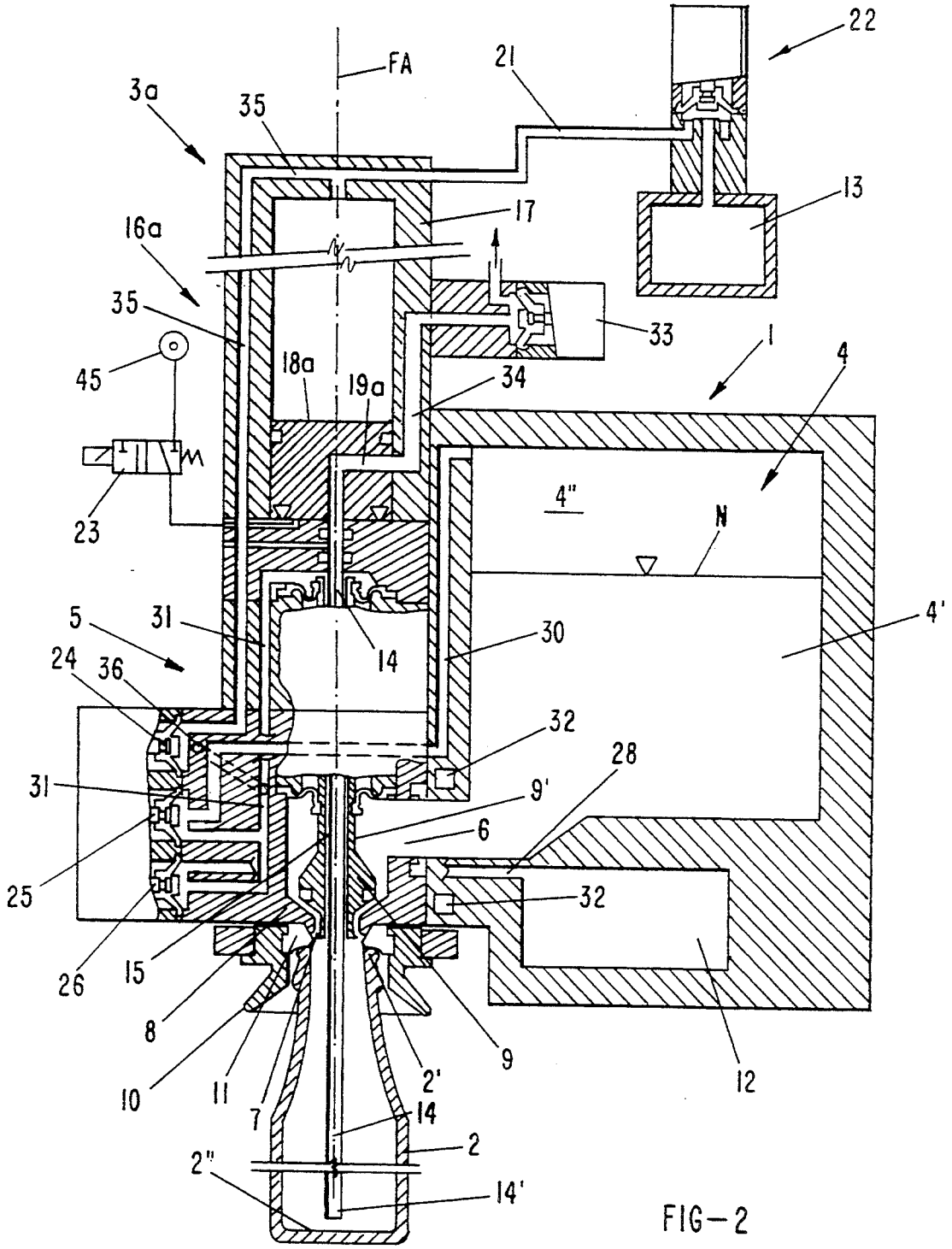
FIGS. 2–4 are views similar to that of FIG. 1 showing further possible exemplary embodiments of the inventive filling element.

FIG. 2 shows a filling element **3*a* that differs from the filling element 3 essentially only by the subsequently to be addressed features, but otherwise corresponds to the filling element 3, so that all elements in the embodiment of FIG. 2 that correspond to the filling element 3 will have the same reference numerals as did the embodiment of FIG. 1, with this also being true for the filling elements 3*b*, 3*c*, 3*d* and 3*e* of FIGS. 3, 4, 6 and 7 and 4** that will be described subsequently.

The filling element **3*a* initially differs from the filling element 3 in that the control means 16*a*, instead of the piston 18, has a piston 18*a* with a channel 19*a* that communicates with the upper end of the sterilization tube 14 and is open merely at the peripheral surface of the piston 18*a*, and in particular in such a way that in the lower stroke position of the sterilization tube 14, the channel 19*a* communicates with a channel 34 that is formed in the cylinder 17 and leads to a further control valve 33**.

In addition, with the filling element **3*a*, instead of the channel 29 a channel 35 is provided that connects the outlet side of the valve 24 to the channel 21**.

Finally, instead of the connecting channel 27, a connecting channel 36 is provided that connects the inlet side of the valve 24 to the channel 31.

An essential difference of the operation of the filling element **3*a* relative to the filling element 3 is that for the steam treatment, with the control valves 22, 24 and 33 open, it is possible to provide a stream of steam out of the supply channel 13 and over the annular channel 15 into the bottle 2 and out of this bottle back through the sterilization tube 14, which is in its lower stroke position, and through the channels 19*a* and 34 and the control valve 33 for example into the residual gas channel 12** or into an additional collection channel.

Figure 3:
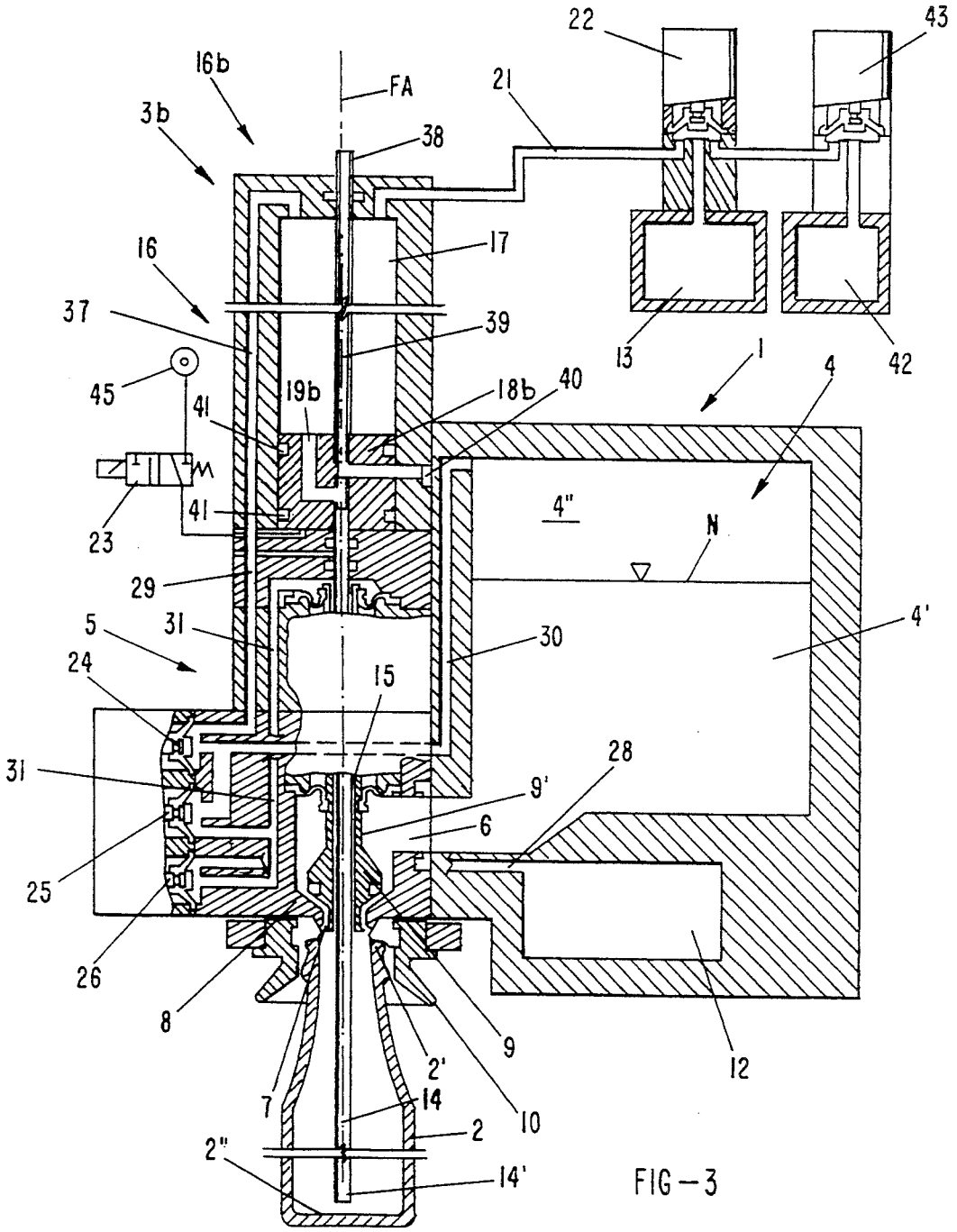

FIG. 3 shows the filling element 3*b* and differs from the filling element 3 essentially by the following features:

The piston 18*b* of the control means 16*b* has a channel 19*b* that again opens into the sterilization tube 14, and is open at the upper side of the piston 18*b*, being offset radially to the axis FA. Instead of the channel 29, a channel 37 is provided that is connected to the outlet side of the control valve 24 and at the upper end of the cylinder 17 opens out into the upper cylinder chamber. With the filling element 3*b*, the connecting channel 27 is eliminated and the inlet side of the control valve 24 is also connected to the channel 30. Furthermore, with the control valve 3*b* an upwardly projecting rod 38 is provided on the piston and is guided to the upper side of the cylinder 17, thus also forming an additional guide means for the sterilization tube 14. The rod 38 has an axially extending channel 39 that is open at the upper side of the rod and communicates with an annular channel 40 that is provided at the periphery of the piston 18*b* between an upper and a lower seal 41. Residual compressed air or steam can be withdrawn via the channels 40 and 39.

Finally, the embodiment illustrated in FIG. 3 is provided with a vacuum channel 42 that is common to all of the filling elements 3*b*. By means of the channel 21, each filling element 3*b* is connected to the vacuum channel 42 via a control valve 43.

By means of the additional connection to the vacuum channel 42, it is possible to provide a vacuum treatment of the bottle 2. Furthermore, with the filling element 3*b* a rinsing of the bottle 2 via the sterilization tube 14 is possible, whereby the tube is moved and held in the lower stroke position by the pressure of the inert gas or $CO_2$ that is used for the rinsing and that is supplied to the upper chamber of the cylinder 17 from the gas chamber 4″ via the opened control valve 24 and the channel 37.

Figure 4:
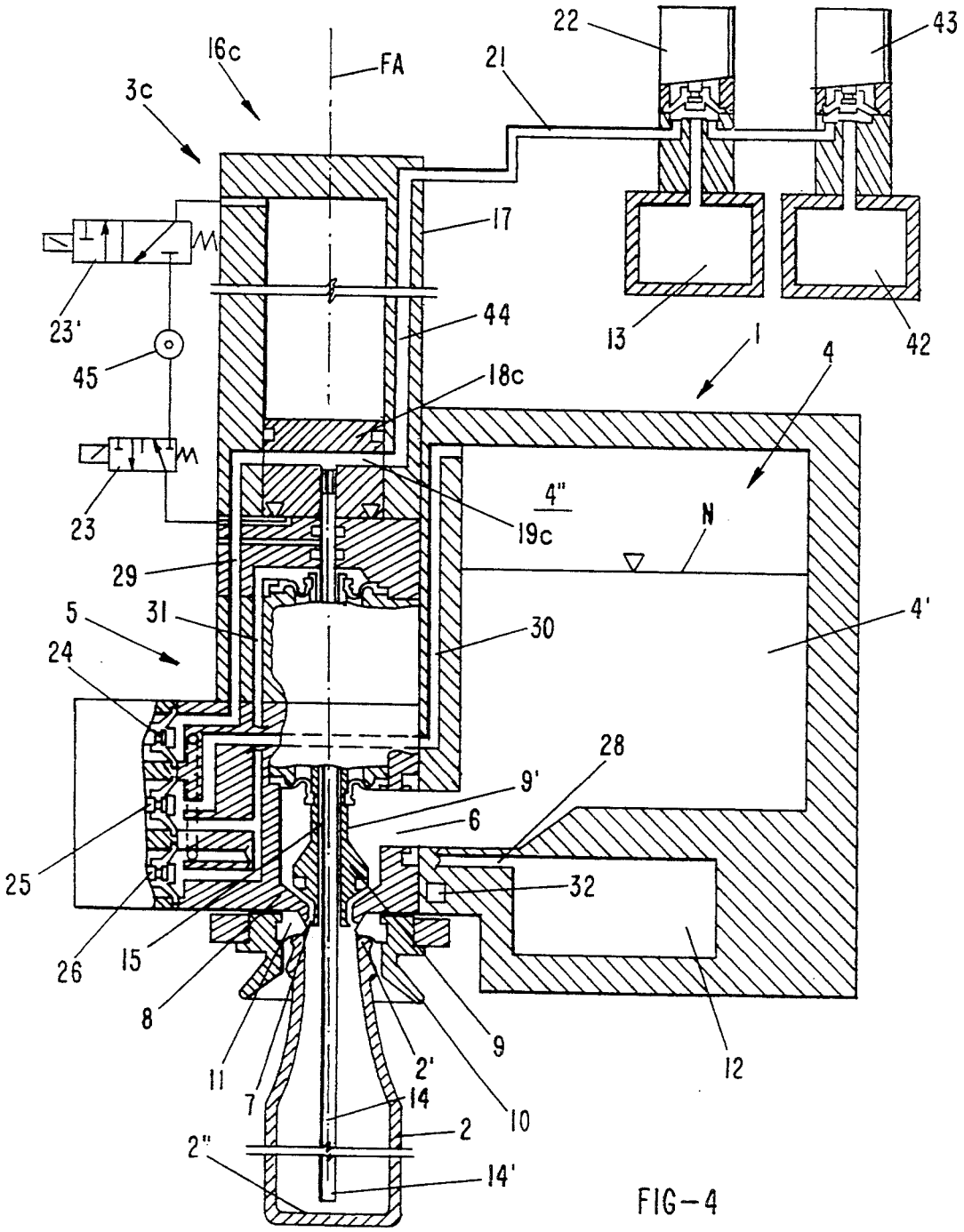

FIG. 4 shows a further possible exemplary embodiment of a filling element 3*c* that differs from the filling element 3 essentially only in that in addition to the supply channel 13 for steam, a vacuum channel 42 is also provided so that by appropriate control of the control valves 22 and 43, the channel 21 can selectively be switched to the supply channel 13 or to the vacuum channel 42.

With the filling element 3*c*, the channel does not open out into the upper chamber of the cylinder 17, but rather into a channel 44 that is formed in the cylinder and that when the sterilization tube 14 or the piston 18*c* of the control means 16*c* is disposed in the lower stroke position, opens out into the channel 19*c* that is provided in the piston 18*c* and that is in constant communication with the sterilization tube 14 and, in the lower stroke position, also with the channel 29. In addition to the control valve 23, the control valve 23′ is provided, both of which are connected to the control pressure or compressed air line 45; the control valve 23′ controls the upper chamber of the cylinder 17 while the control valve 23 continues to control the lower chamber of the cylinder 17. Thus, with the filling element 3*c* the stroke of the sterilization tube 14 in both directions is effected by the control pressure medium (compressed air). In this way, the cylinder chambers of the control means 16*c* are kept completely free of those media that also pass into the respective bottle 2 or serve to treat such a bottle, although of course the additional control valve 23′ must be provided.

With the filling element 3*c*, the methods of operation previously described in conjunction with the filling element 3 are possible, and in addition, however, in particular when using the vacuum in the vacuum channel 42, a suctioning off of condensate via the sterilization tube 14 is possible. For this purpose, the sterilization tube 14 is in the lower stroke position, i.e. by means of the control valve 23′ the upper chamber of the cylinder 17 is supplied with the control pressure and the lower chamber of the cylinder is vented via the control valve 23. The withdrawal of the condensate is effected by closing the control valves 22, 24, 25 and 26 and opening the control valves 43.

Figure 5:
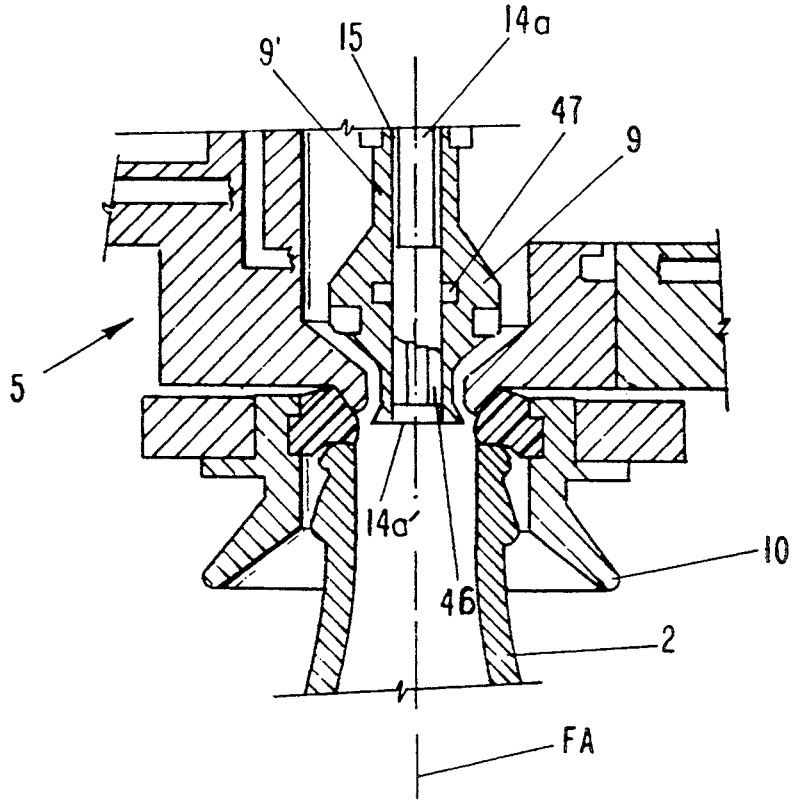
FIG. 5 is a detailed view of the lower end of a sterilization tube, together with a valve body.

As a further exemplary embodiment, FIG. 5 shows a sterilization tube 14*a*, the lower end 14*a*′ of which is provided with a head or valve body 46 that cooperates with a valve seat that is formed, for example, from an O-ring 47 and that is provided on the valve body 9 in the vicinity of the lower, open end of the annular channel 15. In the upper stroke position of the sterilization tube 14*a*, the valve body 46 rests against the O-ring and thereby closes off the annular channel 15. Thus, the sterilization tube 14*a* also serves the function of a control valve. In this way, the control valve 26 of the filling elements 3, 3*a*, 3*b* and 3*c* can be eliminated, with the channel 28 then communicating directly with the channel 31.

With the filling element 3*b* of FIG. 3, the rod 38 is preferably integrally formed with the sterilization tube 14 from a single length of a tubular profiled member, with the inner chamber thereof being closed off in the vicinity of the piston 18*b* so that the sterilization tube 14 and the channel 39 that is separate therefrom result.

As a modification of the previously described embodiments, in place of the flowmeter 32 other elements for determining the filling quantity or the filling height can also be used. For example, light or ultrasonic sensors can be used that sense the level of the liquid filling material in the container via a return gas path or the sterilization tube. Furthermore, the sterilization tube can be embodied as the element that determines the filling height, and in particular preferably with a light or ultrasonic sensor. Finally, weighing devices could be provided for the bottles 2, which are, for example, glass or plastic bottles.

Figure 6:
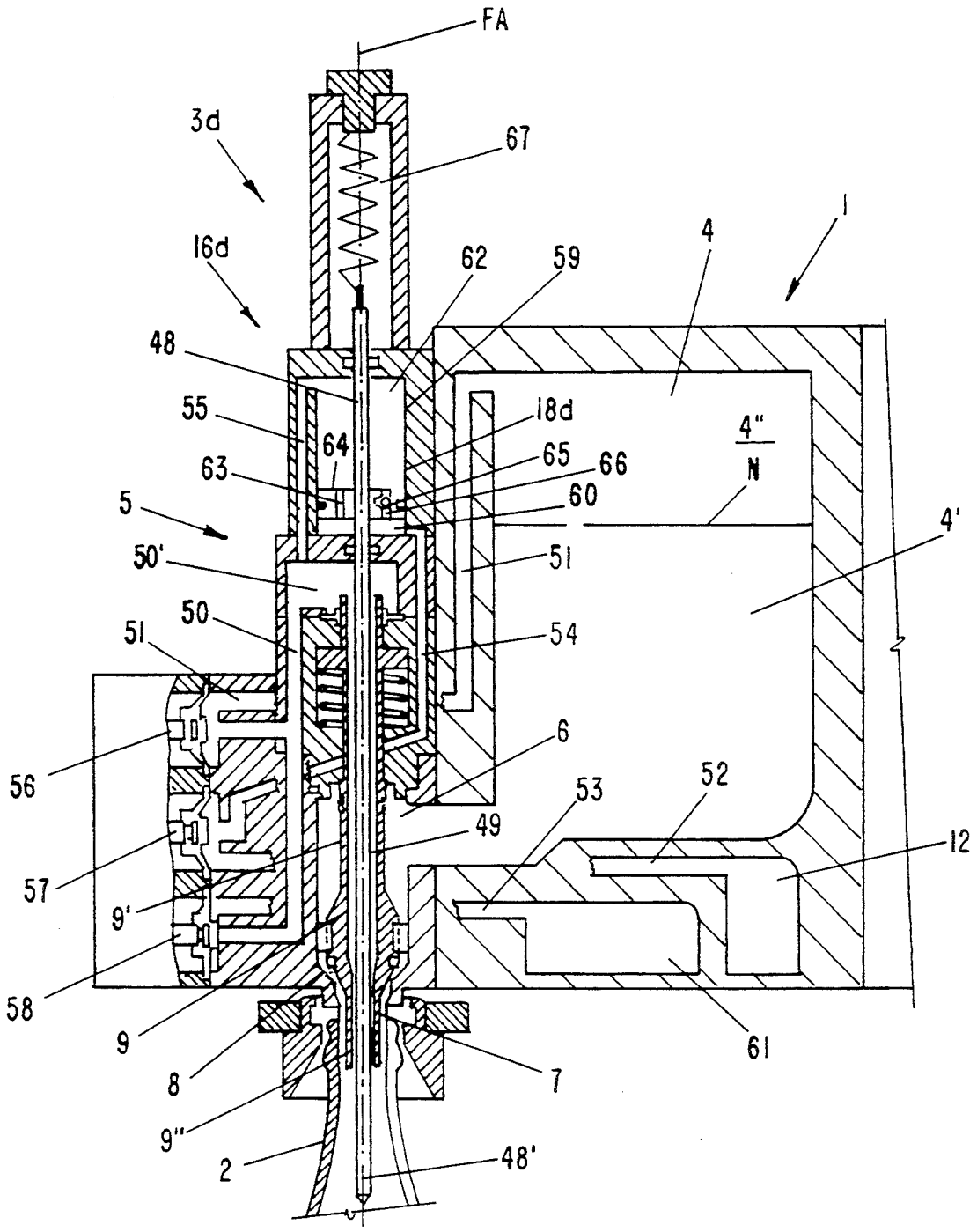
FIGS. 6 and 7 are views similar to that of FIG. 1 of further exemplary embodiments of the inventive filling element.

As a further exemplary embodiment, FIG. 6 shows a filling element 3*d* that differs from the filling element 3 of FIG. 1 essentially only in that no treatment of the bottles 2 with the sterilization medium (steam) is provided, and in conformity therewith instead of the sterilization tube 14 a probe 48 is used that determines the filling height and is axially displaceable in the direction of the filling element axis FA.

In FIG. 6, those elements that correspond in function to that of the elements of FIG. 1 are again designated by the same reference numerals as in FIG. 1. Thus, the filling element 3*d* has a housing 5 that is secured to the outer surface of the annular tank 1 and in which are provided, among other things, the liquid channel 6 with the liquid flow valve 8 that is formed from the valve body 9.

In addition to the upwardly extending tubular or stem-like extension 9′, the valve body 9 also has a lower tubular extension 9″ that extends a short distance into the bottle 2 through the mouth 2′ thereof when the mouth 2′ of the bottle 2 is in a sealing position with the filling element 3*d* via the sealing means 11 of the centering tulip 10. An annular channel 49 that corresponds to the annular channel 15 is formed between the outer surface of the probe 48 and the inner surface of the valve body 9 and the extensions 9' and 9''. At the lower end of the extension 9'', the annular channel 49 is open, and at the top opens out into a chamber 50' of the channel 50 that, like the channels 51–55, is formed partially in the housing 5 and partially in the annular tank 1.

The filling element **3*d* furthermore has three individually controllable control valves 56, 57 and 58 as well as a control means 16*d* that is formed by a piston 18*d* that can be moved up and down in a cylinder 59 in the direction of the filling element axis FA. With the control means 16*d*, the probe 48 is movable between a raised rest position (upper stroke position) in which the probe tip 48 is accommodated by the extension 9'' and is protected thereby, and the lower operating position (lower stroke position) illustrated in FIG. 6 in which the probe 48 projects beyond the lower end of the extension 9'' and its lower tip 48' that forms the active part of the probe 48 extends through the mouth 2' into the interior of the bottle. To allow for its movement, the region of the upper end of the probe 48 is displaceably guided on the upper side and the underside of the cylinder 59. The piston 18*d* is fixedly disposed on the probe 48**.

The channels 50–55 and the control valves 56–58 are connected as follows:

Control valve 56:

The inlet side is connected to the channel 50, which communicates with the chamber 50' and the annular channel 49, and the outlet side is connected to the channel 51, which opens out into the gas chamber 4''.

Control valve 57:

The inlet side is connected to the channel 54 that opens out into a pressure or cylinder chamber 60 that is formed below the piston **18*d*, and the outlet side is connected to the channel 52, which communicates with the return Gas or residual gas channel 12**.

Control valve 58:

The inlet side is connected to the channel 50, and the outlet side is connected to the channel 53, which opens out into a vacuum channel 61 that is provided in the annular tank 1 in common for all of the filling elements **3*d*** of the filling machine.

By means of the channel 55 there is furthermore provided a communication between the channel 50 and the pressure or cylinder chamber 62 that is formed above the piston **18*d*. The openings of the channels 54 and 55 into the pressure chambers 60 and 62** are respectively disposed on the lower and upper walls that delimit these pressure chambers.

Provided in the piston **18*d* are an opening 64, which connects the pressure chambers 60 and 62 and is provided with a nozzle, restrictor or flow control means 63, as well as an opening 66 that similarly connects the pressure chambers 60 and 62 and is provided with a check valve 65. The check valve is embodied in such a way that it permits a flow of medium out of the cylinder chamber 60 and into the cylinder chamber 62 through the opening 66**, but blocks flow in the opposite direction.

The basic advantage of the filling element **3*d* consists in that the movement of the probe 48 between the upper stroke position and the lower stroke position is effected by the treatment medium, namely the inert gas that is used for the pressurization, with this being effected in a controlled manner via one of the control valves, namely the control valve 56, that is necessary anyway for filling the bottles 2**.

As will now be described in detail, the filling element **3*d* permits the following manner of operation, whereby in the following description it will be assumed that the control valves 56–58** are closed unless in a specific step the opened state of a control valve is indicated:

1. Preliminary Evacuation

For this purpose, the control valve 56 is opened. The bottle 2, which is disposed in a sealed position against the filling element **3*b*, is evacuated by means of the vacuum channel 61. In so doing, via the channel 55 an overpressure is also established in the cylinder chamber 62 through which the probe 48** is moved into the upper stroke position if this position does not already exist.

2. Intermediate rinsing and partial pressurization

For this purpose, the control valve 58 is opened so that gas from the return gas channel 12 passes via the channels 52 and 54 into the cylinder chamber 60, and from there via the opening check valve 65 also into the cylinder chamber 62 and from there via the channel 55 into the annular channel 49, from where the gas enters the bottle 2. Since the two pressure chambers 60 and 62 are essentially at the same pressure, with the pressure in the cylinder chamber 60 possibly being greater due to a pressure drop in the openings 64 and 66, the piston **18*b* and hence the probe 48** remain in the upper stroke position.

3. Pressurization and rapid filling

For this step, the control valve 56 is opened, whereby via the channels 50, 51 and 55 the pressure of the gas chamber 4'', which is greater than the pressure of the return gas channel 12, becomes effective in the cylinder chamber 62, as a result of which the piston **18*d*, and along with it the probe 48**, are moved into the lower stroke position.

By means of the opened control valve 56, the channels 50 and 51, and the annular channel 49, the interior of the bottle 2 communicates with the gas chamber 4'', so that on the one hand pressurization of the bottle 2 with the gas from the gas chamber 4'' is effected, and on the other hand (after opening of the liquid flow valve 8) the gas that is displaced out of the bottle 2 during filling is returned to the gas chamber 4''.

4. Retarded or slow filling

For this purpose, the control valve 57 is opened so that via the annular channel 49, the channel 55, the cylinder chamber 62, the flow control means 63, the cylinder chamber 60, the channel 54, and the channel 52, a communication to the return gas channel 12 is established for the gas that is displaced out of the bottle 2 during filling. The filling speed in this slow filling phase is determined by the flow control means 63 that is provided in the piston **18*d***.

In this phase of the filling process, the pressure in the cylinder chamber 62 (filling pressure) is greater than the pressure in the cylinder chamber 60 (return gas pressure), so that the probe 48 remains in its lower operating position.

5. Preliminary venting of the bottle

After response or operation of the probe 48, the actual filling phase is brought to an end by closing the liquid flow valve 8. For the preliminary venting, the control valve 57 remains open. The pressure in the bottle 2 is then slowly reduced to the level of the pressure of the return gas channel 12. At the end of this process, a pressure equalization is achieved between the pressure chambers 60 and 62. However, the piston **18*d* and the probe 48** remain in the lower stroke position.

6. Final venting

By briefly opening the control valve 58, the overpressure that still exists in the bottle 2 is reduced to atmospheric pressure. For this purpose, a connection to the vacuum channel 61 is established via the annular channel 49 and the channels 50 and 53. At the same time, the pressure in the pressure chambers 60 and 62 is also reduced via the channel 55.

When the filled bottle 2 is withdrawn from the filling element 3*d*, the control valve 57 is again briefly opened so that via the channels 52 and 54 the cylinder chamber 60 is supplied with the pressure of the return gas channel 12, which pressure is greater than atmospheric pressure, so that the piston 18*d* and the probe 48 are returned to their upper stroke position, i.e., the tip 48' of the probe is moved out of the bottle 2 and is retracted into the extension 9''.

The reference numeral 67 indicates a spring that compensates for the weight of the piston 18*d* and the probe 48 at least to such an extent that the probe 48 remains in every stroke position without the need for a treatment medium to act upon the piston 18*d*. In addition, or in place thereof, the spring 67 also serves as an electrical connector between the probe 48 and an electrical contact or conductor on the housing.

The filling element 3*d* has the advantage that no additional operating medium (such as compressed air, electrical current) is needed for the movement of the probe 48.

The above described embodiment enables a straightforward cleaning of the filling element 3*d* and hence in particular also of the control means 16*d*; the cleaning methods are as follows:

1. CIP feed via the return gas channel

In this cleaning step, the liquid cleaning medium, with the control valve 57 opened, passes out of the return gas channel 12 and through the channels 52 and 54 into the cylinder chamber 60, and from there via the flow control means 63 and primarily also via the check valve 65, into the cylinder chamber 62, from where the cleaning medium can flow off into the CIP return. The piston 16*d* and the probe 48 are in the upper stroke position and are held in this position since due to the pressure drop in the opening 64 and 66, the pressure in the cylinder chamber 60 is greater than in the cylinder chamber 62.

2. CIP feed via the inner chamber 4 of the tank

Here the liquid cleaning medium passes out of the inner chamber 4 of the tank through the opened liquid flow valve 8 and a rinsing sleeve, which is not illustrated but Just like the bottle 2 is in a sealing position relative to the filling element 3*d*, into the annular channel 49, and from there via the channel 50 and the channel 55 into the cylinder chamber 62. Due to the pressure of the cleaning medium, the piston 18*d* and the probe 48 are moved and held in the lower position. The cleaning medium flows through the nozzle or flow control means 63 into the cylinder chamber 60 and from there through the channel 54 and the opened control valve 57 into the return gas channel 12.

By means of the CIP feed via the return gas channel 12 and via the inner chamber 4 of the tank, both pressure chambers 60 and 62 are thus included in the cycle of the CIP cleaning. By changing the direction of flow with which the cleaning medium flows through the control means 16*d*, it is also possible to include all of the surfaces of the cylinder 59 and also of the piston 18*d* in the cleaning process.

Figure 7:
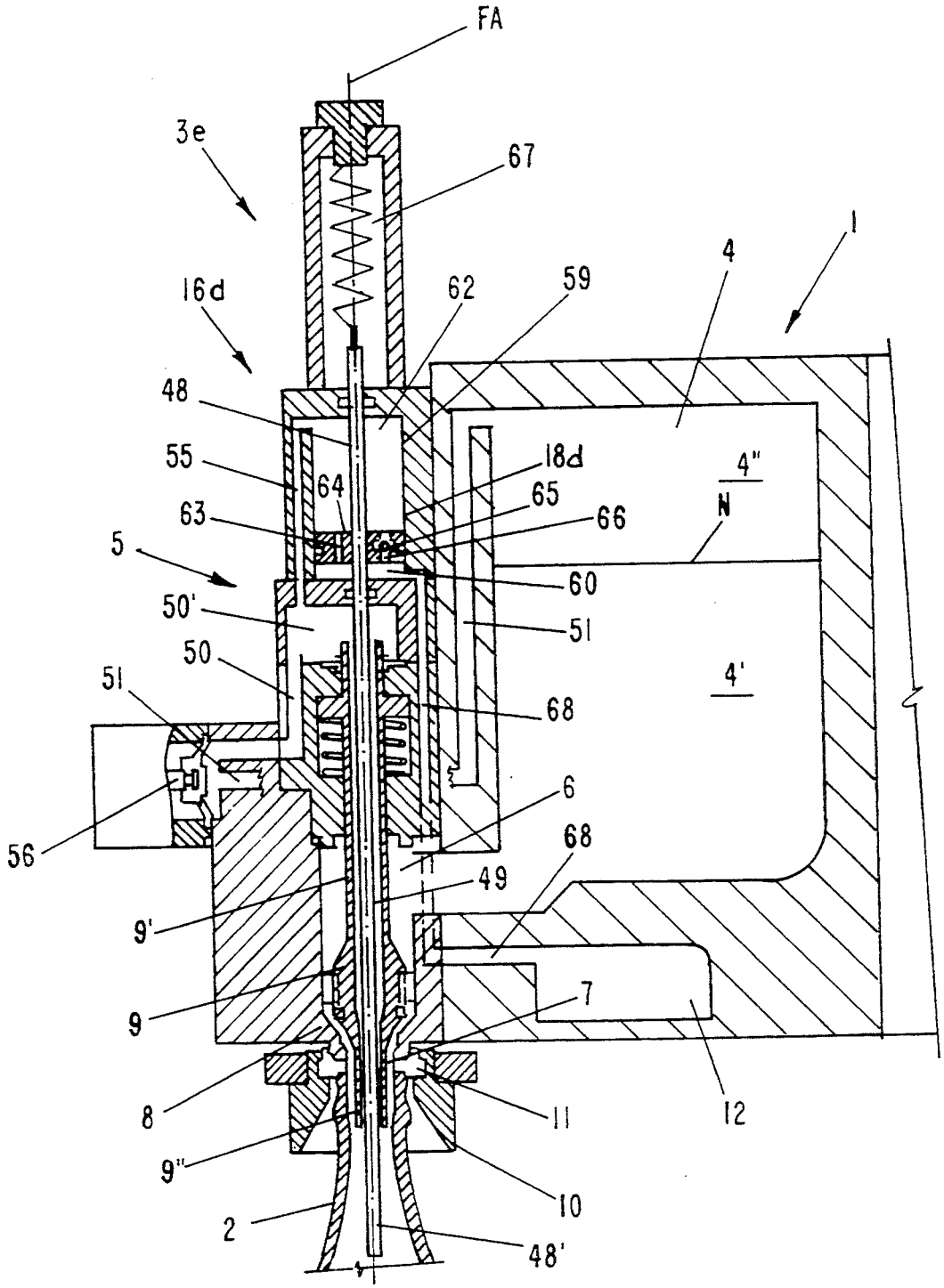

In a view similar to FIG. 6, FIG. 7 shows a filling element 3*e* that differs from the filling element 3*d* essentially only in that the channels 52, 53 and 54, the control valves 57 and 58, as well as the vacuum channel 61 are eliminated, and instead of the channel 53 a channel 68 is provided that continuously connects the return gas channel 12 to the cylinder chamber 60, and in particular in the region of the lower end face of the cylinder 59. Despite the very straightforward configuration, and despite the use of only a single control valve 56, it is possible, in addition to the customary pressurization, rapid filling, retarded filling, preliminary venting, and final venting, to provide a controlled raising and lowering of the probe 48 via the control media, and in particular as a function of the control valve 56. Details of the stroke movement of the probe 48 in the individual filling phases follow:

1. Pressurization:

Until a bottle 2 is pressed against the filling element 3*e*, there exists in the cylinder chamber 60 the pressure of the return gas channel 12, so that the piston 18*d* and the probe 48 are in the upper stroke position.

Immediately after a bottle has been pressed against the filling element, the control valve 56 is opened so that for the pressurization via the channels 50 and 51 and the annular channel 49, a communication is established between the gas chamber 4'' and the interior of the bottle 2. At the same time, via the channel 55 the cylinder chamber 62 is subjected to the pressure of the gas chamber 4'', which pressure is greater than the pressure in the return gas channel 12, so that the piston 18*d* and the probe 48 move into their upper stroke position and the tip 48' of the probe 48 is introduced into the bottle 2 and thereby assumes its measuring position.

2. Rapid filling

With the control valve 56 continuing to be open, and with the liquid flow valve 8 opened, the rapid filling is effected. Since the cylinder chamber 62 continues to be subjected to the pressure of the gas chamber 4'', the probe 48 remains in the lower position.

3. Retarded filling

To reduce the filling speed, the control valve 56 is closed so that the gas that is displaced out of the bottle 2 during the filling process can flow off through the annular channel 49, the channel 55, the cylinder chamber 62, the flow control means 63, the cylinder chamber 60, and the channel 68 into the return gas channel 12. Since the pressure in the cylinder chamber 62 continues to be higher than in the cylinder chamber 60, the probe 48 remains in the lower stroke position.

4. Preliminary Venting

After response of the probe 48, the liquid flow valve 8 is closed. Immediately after closing of the liquid flow valve 8, the pressure in the bottle 2 drops via the flow control means 63 to the pressure level of the return gas channel 12.

The pressure in the return gas channel 12 is set to an overpressure of, for example, between 0.5 and 1.0 bar. At the conclusion of the preliminary venting, a pressure equalization is reached between the pressure chambers 60 and 62. The probe 48 remains in the lower stroke position.

5. Final venting

This final venting to atmospheric pressure is effected by withdrawing the bottle 2 from the filling element 3*e*. In so doing, the cylinder chamber 62 is vented to atmospheric pressure via the channel 55 and the annular channel 49. The overpressure from the return gas channel 12 that is still effective in the cylinder chamber 60 moves the piston 18*d*, and therewith the probe 48, into the upper stroke position, so that the probe 48 is withdrawn out of the bottle 2 and into the extension 9".

With the filling element 3*d* a cleaning of the control means 16*d* is also possible as follows:

1. CIP feed via the return gas channel 12

The cleaning medium passes out of the return gas channel 12 and into the cylinder chamber 60, and from there partially via the flow control means 63 and partially via the check valve 65 into the cylinder chamber 62, out of which the cleaning medium passes via the channel 55 and the annular channel 49 into a rinsing bell that is provided on the filling element; the cleaning medium then flows out of the rinsing bell and through the opened liquid flow valve into the inner chamber 4 of the tank.

Due to the pressure of the cleaning medium, the piston 18*d* and the probe 48 are moved into the upper stroke position.

2. CIP feed via the annular tank or the inner chamber of the tank

With a rinsing bell provided on the filling element 3*e* and with the liquid flow valve 8 opened, the cleaning medium passes out of the inner chamber 4 of the tank and through the annular channel 49 and the channel 55 into the cylinder chamber 62, and from there via the flow control means 62 into the cylinder chamber 60, out of which the cleaning medium then flows off through the channel 68 to the return gas channel 12. Due to the higher pressure of the cleaning medium in the cylinder chamber 62, the piston 18*d* and the probe 48 are moved downwardly.

During the change of the direction of flow of the cleaning medium, and due to the movement of the piston 18*d* caused thereby, with this embodiment also there is ensured that all of the surfaces of the cylinder 59 and of the piston 18*d*, and especially also the end face surfaces, are included in the cleaning.

It should be noted that with an appropriate configuration, the inventive filling element can also be used for filling cans.

With a filling machine, all of the control valves of the filling elements 3–3*e*, including the liquid flow valves of these elements, are controlled by a central control mechanism.

Prior to placing a filling machine having the filling elements 3–3*e* into operation, one must ensure that the filling material chamber 4' of the annular tank 1 has the liquid filling material, that the gas chamber 4" has the inert gas with the required pressure, and that those channels and connections that during the operation convey an operating medium have this operating medium at the required pressure.

The present invention is, of course, in no way restricted to the specific disclosure of the specification and drawings, but also encompasses any modifications within the scope of the appended claims.

What is claimed is:

1. A filling element for filling machines for dispensing a liquid filling material into containers placed beneath said filling element, said filling element having a liquid channel that is provided with a liquid flow valve therein which forms a discharge opening via which, during a filling phase, said liquid filling material flows into a container that has been placed against said filling element, said filling element further comprising:

an operational element that is adapted to be introduced into said container; and a control means for moving said operational element, in the direction of an axis of said filling element, between a lower stroke position, in which at least in said filling phase a given length of said operational element extends beyond an underside of said filling element and into said container that has been placed against said filling element, and an upper stroke position in which at least a portion of said given length of said operational element is retracted into said filling element, and wherein said control means is a piston/cylinder arrangement with at least one cylinder and one piston that is displaceable therein, with said piston defining within said at least one cylinder at least one cylinder chamber to which, for a stroke movement of said operational element, can be supplied the pressure of at least one operating medium that is also supplied to said container during at least one of said filling phase and treatment phases that precede and follow said filling phase.

2. A filling element according to claim 1, wherein said operating medium is at least one of the materials selected from the group consisting of a vacuum gas, a compressed gas, preferably an inert compressed gas, and a sterilization medium, preferably steam.

3. A filling element according to claim 1, wherein said operational element is an element that determines a filling height within said container.

4. A filling element according to claim 3, wherein said operational element is a probe.

5. A filling element according to claim 3, which includes at least one gas channel for the supply and/or withdrawal of said at least one operating medium to and out of said container that has been placed against said filling element, said at least one gas channel being open at the underside of said filling element and opening out into an interior of said container, and which also includes at least one operating medium connection that is controllable by further control means.

6. A filling element according to claim 5, wherein said at least one cylinder chamber forms at least one operating medium connection or communicates with at least one operating medium connection.

7. A filling element according to claim 5, wherein said liquid flow valve is provided with a valve body that is movable by a prescribed stroke in said filling element axis, and wherein said operational element is guided through an opening of said valve body and is movable relative thereto, said valve body being disposed at a lower end of a valve stem or a plunger-like extension and said operational element is guided through said opening of said valve body and an opening of said extension in such a way that said gas channel is formed between an outer surface of said operational element and an inner surface of said opening in said valve body and said extension.

8. A filling element according to claim 5, wherein said operational element forms an element of a valve that in said upper stroke position closes off said gas channel, said element of a valve being in the form of a valve body disposed on a lower end of said operational element, whereby in said upper stroke position of said operational element, said valve body rests against a valve seat to thereby close off said gas channel.

9. A filling element according to claim 1, wherein said operational element is a sterilization tube, wherein said given length thereof, in said lower stroke position, projects into said container, and wherein said sterilization tube, via a sterilization medium connection that is controllable via a first control device, is connectable to a source for sterilization medium for treating an interior of said container with said sterilization medium that flows through said tube in a sterilization phase in which, in said lower stroke position, said sterilization tube has at least one opening that is formed in the vicinity of a lower end of said given length thereof disposed so deep in said container that said sterilization medium is supplied even to a base portion of said container opposite a mouth portion thereof.

10. A filling element according to claim 9, wherein the pressure of said sterilization medium can be supplied to said at least one cylinder chamber via a control device, preferably said first control device, for a movement of said sterilization tube into said lower stroke position.

11. A filling element according to claim 9, wherein said piston is provided with a channel that connects an interior of said sterilization tube with said at least one cylinder chamber.

12. A filling element according to claim 9, wherein said piston is provided with a channel that not only communicates with said sterilization tube, but in at least one stroke position of said piston and said sterilization tube also communicates with a channel that is formed at least partially in said cylinder, said channel in said piston preferably having an opening on a peripheral surface of said piston and in said one stroke position being aligned with an opening of said channel that is formed at least partially in said cylinder.

13. A filling element according to claim 9, wherein at least one of said control means, said sterilization medium connection, and said first control device are controllable in such a way that one of the following occurs: already with a movement of said sterilization tube out of said upper stroke position and into said lower stroke position, said sterilization medium is discharged from said sterilization tube; during said filling phase with said liquid flow valve open, and preferably also during a pressurizing phase that precedes said filling phase, said sterilization tube is in said upper stroke position, and in said lower stroke position; of said sterilization tube, said lower end thereof is disposed immediately adjacent said base portion of said container.

14. A filling element according to claim 5, wherein at least one vacuum connection is provided that has a second control device and via which at least one of said gas channel and said operational element in the form of a sterilization tube is connectable in a control led manner to a vacuum source, and wherein said at least one cylinder chamber can also be subjected in a controlled manner via said second control device to the vacuum of said vacuum source.

15. A filling element according to claim 5, wherein at least one connection for an inert compressed gas is provided and is controllable via a third control device and via which said gas channel can be connected in a control led manner with a source for said inert gas, and wherein said at least one cylinder chamber can be subjected in a controlled manner via said third control device to the pressure of said source of inert gas.

16. A filling element according to claim 15, wherein said third control device has at least two control valves via which said gas channel can be connected in a controlled manner with a return gas channel or with a source for a pressurized gas, for example with the gas chamber of a tank of said filling machine or with a pressurized gas channel.

17. A filling element according to claim 15, wherein at least one opening, preferably provided with at least one nozzle and/or one check valve, is provided in said piston of said control means, and wherein said at least one gas path connection encompasses both cylinder chambers of said control means and proceeds via said at least one opening.

18. A filling element according to claim 15, wherein one of said cylinder chambers, preferably that cylinder chamber that effects raising of said operational element, can be connected to said residual gas channel via at least one control valve of said third control device, and wherein the other cylinder chamber, preferably that cylinder chamber that when pressure is supplied effects a lowering of said operational element, can be supplied with pressurized inert gas via at least one other control, valve of said third control device.

19. A filling element according to claim 1, wherein a respective one of said at least one cylinder chamber to which can be supplied an operating medium is formed on opposite sides of said piston, and wherein at least one control valve is provided for controlling at least one of said cylinder chambers.

20. A filling element according to claim 19, wherein at least a lower one of said cylinder chambers that faces said underside of said filling element and effects movement of said operational element into an upper stroke position is controllable via a pressure medium control valve.

21. A filling element according to claim 1, wherein a means that surrounds said discharge opening and receives a mouth of said container is provided, wherein a centering means for said container is provided, wherein in said upper stroke position, a lower end of said given length of said operational element is disposed in the vicinity of at least one of said discharge opening, said means that surrounds said discharge opening and receives a mouth of said container, said centering means for said container, and a tubular or sleevelike member that surrounds said operational element, and wherein said discharge opening is radially offset relative to an axis of said operational element and preferably concentrically surrounds said axis.

22. A filling element according to claim 21, wherein said means that surrounds said discharge opening is an abutment or a sealing element.

23. A filling element according to claim 1, wherein a spring is provided that engages said operational element and establishes an electrical connection between said operational element and an electrical connector or conductor that is not moved along with said operational element.

* * * * *